US006957994B2

(12) United States Patent
Derraa

(10) Patent No.: US 6,957,994 B2
(45) **Date of Patent: *Oct. 25, 2005**

(54) METHOD OF FABRICATING FIELD EMISSION ARRAYS EMPLOYING A HARD MASK TO DEFINE COLUMN LINES AND ANOTHER MASK TO DEFINE EMITTER TIPS AND RESISTORS

(75) Inventor: Ammar Derraa, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/654,226

(22) Filed: Sep. 2, 2003

(65) Prior Publication Data

US 2004/0048544 A1 Mar. 11, 2004

Related U.S. Application Data

(63) Continuation of application No. 10/114,632, filed on Apr. 2, 2002, now Pat. No. 6,612,891, which is a continuation of application No. 09/847,926, filed on May 3, 2001, now Pat. No. 6,398,609, which is a continuation of application No. 09/626,481, filed on Jul. 26, 2000, now Pat. No. 6,276,982, which is a continuation of application No. 09/472,571, filed on Dec. 27, 1999, now Pat. No. 6,133,057, which is a continuation of application No. 09/260,214, filed on Mar. 1, 1999, now Pat. No. 6,059,625.

(51) Int. Cl.[7] ..... H01J 9/02; H01J 9/00

(52) U.S. Cl. ..... 445/50; 445/24; 445/49; 445/51

(58) Field of Search ..... 313/495, 309, 313/351, 336; 445/49, 50, 24, 51

(56) References Cited

U.S. PATENT DOCUMENTS

| | | | |
|---|---|---|---|
| 4,193,226 | A | 3/1980 | Gill, Jr. et al. |
| 4,811,522 | A | 3/1989 | Gill, Jr. |
| 5,229,331 | A | 7/1993 | Doan et al. |
| 5,302,238 | A | 4/1994 | Roe et al. |
| 5,312,514 | A | 5/1994 | Kumar |
| 5,329,207 | A | 7/1994 | Cathey et al. |
| 5,372,973 | A | 12/1994 | Doan et al. |
| 5,374,868 | A | 12/1994 | Tjaden et al. |
| 5,451,830 | A | 9/1995 | Huang |
| 5,475,280 | A | 12/1995 | Jones et al. |
| 5,585,301 | A | 12/1996 | Lee et al. |
| 5,594,298 | A | 1/1997 | Itoh et al. |
| 5,633,560 | A | 5/1997 | Huang |

(Continued)

*Primary Examiner*—Mariceli Santiago
(74) *Attorney, Agent, or Firm*—TraskBritt, PC

(57) ABSTRACT

An emission structure includes a resistor with at least one emitter tip thereover and at least one substantially vertically oriented conductive element positioned adjacent the resistor. The conductive element may contact the resistor. A method for fabricating the emission structure includes forming at least one conductive line, depositing at least one layer of semiconductive or conductive material over and laterally adjacent the at least one conductive line, and forming a hard mask in recessed areas of the surface of the uppermost material layer. The underlying material layer or layers are patterned through the hard mask, exposing substantially longitudinal center portions of the conductive lines. The remaining semiconductive or conductive material is patterned to form the emitter tip and resistor. At least the substantially central longitudinal portion of the conductive trace is removed to form the conductive element.

18 Claims, 6 Drawing Sheets

U.S. PATENT DOCUMENTS 5,637,023 A 6/1997 Itoh et al.
5,641,706 A 6/1997 Tjaden et al.
5,656,886 A 8/1997 Westphal et al.
5,669,801 A 9/1997 Lee
5,696,385 A 12/1997 Song et al.
5,711,694 A 1/1998 Levine et al.
5,712,534 A 1/1998 Lee et al.
5,735,721 A 4/1998 Choi
5,828,163 A 10/1998 Jones et al.
5,895,580 A 4/1999 Liu et al.
5,965,218 A 10/1999 Bothra et al.
6,012,958 A 1/2000 Tjaden et al.
6,017,772 A * 1/2000 Derraa ..... 445/50
6,059,625 A 5/2000 Derraa
6,133,057 A 10/2000 Derraa
6,210,985 B1 4/2001 Derraa
6,239,538 B1 5/2001 Konuma
6,276,982 B1 * 8/2001 Derraa ..... 445/50
6,326,222 B2 12/2001 Derraa
6,329,744 B1 12/2001 Derraa
6,387,718 B2 5/2002 Derraa
6,398,609 B2 6/2002 Derraa
6,552,478 B2 4/2003 Derraa
6,612,891 B2 9/2003 Derraa
6,635,983 B1 10/2003 Raina et al.

* cited by examiner

METHOD OF FABRICATING FIELD EMISSION ARRAYS EMPLOYING A HARD MASK TO DEFINE COLUMN LINES AND ANOTHER MASK TO DEFINE EMITTER TIPS AND RESISTORS

CROSS-REFERENCE TO RELATED APPLICATIONS

This application is a continuation of application Ser. No. 10/114,632, filed Apr. 2, 2002, now U.S. Pat. No. 6,612,891 issued Sep. 2, 2003, which is a continuation of application Ser. No. 09/847,926, filed May 3, 2001, now U.S. Pat. No. 6,398,609, issued Jun. 4, 2002, which is a continuation of application Ser. No. 09/626,481, filed Jul. 26, 2000, now U.S. Pat. No. 6,276,982, issued Aug. 21, 2001, which is a continuation of application Ser. No. 09/472,571, filed Dec. 27, 1999, now U.S. Pat. No. 6,133,057, issued Oct. 17, 2000, which is a continuation of application Ser. No. 09/260,214, filed Mar. 1, 1999, now U.S. Pat. No. 6,059,625, issued May 9, 2000.

BACKGROUND OF THE INVENTION

1. Field of the Invention

The present invention relates to methods of fabricating field emission arrays. Particularly, the present invention relates to field emission array fabrication methods wherein the emitter tips and their corresponding resistors are fabricated through a single mask. More particularly, the present invention relates to field emission array fabrication methods that employ only one mask to define the emitter tips and their corresponding resistors and that do not require a mask to define the column lines thereof.

2. Background of Related Art

Typically, field emission displays ("FEDs") include an array of pixels, each of which includes one or more substantially conical emitter tips. The array of pixels of a field emission display is typically referred to as a field emission array. Each of the emitter tips is electrically connected to a negative voltage source by means of a cathode conductor line, which is also typically referred to as a column line.

Another set of electrically conductive lines, which are typically referred to as row lines or as gate lines, extends over the pixels of the field emission array. Row lines typically extend across a field emission display substantially perpendicularly to the direction in which the column lines extend. Accordingly, the paths of a row line and of a column line typically cross proximate (above and below, respectively) the location of an emitter tip. The row lines of a field emission array are electrically connected to a relatively positive voltage source. Thus, as a voltage is applied across the column line and the row line, electrons are emitted by the emitter tips and accelerated through an opening in the row line.

As electrons are emitted by emitter tips and accelerate past the row line that extends over the pixel, the electrons are directed toward a corresponding pixel of a positively charged electro-luminescent panel of the field emission display, which is spaced apart from and substantially parallel to the field emission array. As electrons impact a pixel of the electro-luminescent panel, the pixel is illuminated. The degree to which the pixel is illuminated depends upon the number of electrons that impact the pixel.

Numerous techniques have been employed to fabricate field emission arrays and the resistors thereof. An exemplary field emission array fabrication technique includes fabricating the column lines and emitter tips prior to fabricating a dielectric layer and the overlying grid structure, such as by the methods of U.S. Pat. No. 5,302,238, issued to Fred L. Roe et al. on Apr. 12, 1994, and U.S. Pat. No. 5,372,973, issued to Trung T. Doan et al. on Dec. 13, 1994. Alternatively, a field emission array may be fabricated by forming the dielectric layer and the overlying grid structure, then disposing material over the grid structure and into openings therethrough to form the emitter tips, such as by the technique disclosed by U.S. Pat. No. 5,669,801, issued to Edward C. Lee on Sep. 23, 1997. Such conventional field emission array fabrication methods typically require the use of masks to independently define the various features, such as the column lines, resistors, and emitter tips, thereof.

Another exemplary method of fabricating field emission arrays is taught in U.S. Pat. No. 5,374,868 (hereinafter "the '868 Patent"), issued to Kevin Tjaden et al. on Dec. 20, 1994. The fabrication method of the '868 Patent includes defining trenches in a substrate. The trenches correspond substantially to columns of pixels of the field emission array. A layer of insulative material is disposed over the substrate, including in the trenches thereof. A layer of conductive material and a layer of cathode material (e.g., polysilicon) are sequentially disposed over the layer of insulative material. A mask may then be disposed over the layer of cathode material and the emitter tips and their corresponding column lines defined through the cathode material and "highly conductive" material layers, respectively. The method of the '868 Patent is, however, somewhat undesirable in that the mask thereof is not also employed to fabricate resistors, which limit high current and prevent device failure. Moreover, in the embodiment of the method of the '868 Patent that employs a single mask to fabricate both the emitter tips and their corresponding column lines, neither the "highly conductive" material nor the cathode material is planarized. Thus, the layer of cathode material may have an uneven surface and the heights of the emitter tips defined therein may vary substantially. In embodiments of the method of the '868 Patent where the layer of "highly conductive" material is planarized, only the emitter tips are defined through the mask.

Accordingly, there is a need for a field emission array fabrication process that employs a minimal number of mask steps to define emitter tips of substantially uniform height, their corresponding resistors, and their corresponding column lines.

SUMMARY OF THE INVENTION

The present invention includes a method of fabricating the pixels of a field emission array and, in particular, defining emitter tips and their corresponding resistors by employing a single mask. The field emission array fabrication method of the present invention may also include electrically isolating adjacent column lines from one another without requiring the use of an additional mask. Field emission arrays fabricated in accordance with the inventive method are also within the scope of the present invention.

The method of the present invention includes defining a plurality of substantially mutually parallel conductive lines on a substrate. In order to define the conductive lines, a layer of conductive material may be deposited onto the substrate. The conductive lines may be defined from the conductive layer by known processes. Alternatively, conductive material may be selectively deposited onto the substrate, as known in the art, to define the conductive lines.

One or more layers of semiconductive material or conductive material, from which the emitter tips and their corresponding resistors of the field emission array will be defined, may be disposed over each of the conductive lines and over the regions of the substrate that are exposed between adjacent conductive lines. The layer or layers of semiconductive material or conductive material are also referred to herein as the emitter tip-resistor layer or as the emitter tip layer and resistor layer, respectively. The emitter tip and resistor layer or layers may be disposed over the conductive lines and the substrate by known processes and in a thickness that corresponds to a desired height of the emitter tips and their corresponding resistors. As each of the conductive lines protrudes somewhat from the surface of the substrate, a cross section of the emitter tip and resistor layer or layers has a peak and valley appearance. The peaks of the emitter tip and resistor layer or layers are disposed substantially above the conductive lines, while the valleys of the emitter tip and resistor layer or layers are disposed substantially between adjacent column lines. Due to this peak and valley appearance, if the emitter tip and resistor layer or layers are planarized, the heights of the emitter tips and the resistors are defined somewhat by the relative heights of the conductive lines and the thickness of material remaining above the conductive lines following planarization.

A layer of mask material may be disposed over the emitter tip and resistor layer or layers. Such a mask material may be removed from substantially above the conductive lines (i.e., from above the "peaks") by known processes to define a so-called "hard mask" from the remaining mask material (i.e., the regions located in the "valleys"). Upon exposure of regions of the emitter tip and resistor layer or layers, regions of the emitter tip and resistor layer or layers disposed above the substantially longitudinal center portion of each of the conductive lines may be substantially removed by known processes to expose the substantially longitudinal center portion of the conductive lines. Exemplary processes that may be employed to remove material from these regions of the emitter tip and resistor layer or layers include, without limitation, the use of etchants that are selective for the material or materials of the emitter tip and resistor layer or layers over the mask material.

The emitter tip and resistor layer or layers may be planarized by known processes, such as by chemical-mechanical planarization ("CMP"). Upon such planarization, the peaks and possibly portions of the valleys proximate the surface of the uppermost layer of semiconductive material or conductive material are removed and a substantially planar surface is formed.

The emitter tips and resistors of the field emission array may be defined through the remaining portions of the emitter tip and resistor layer or layers by disposing a mask over the exposed surface of the field emission array and defining apertures therethrough in locations to facilitate the selective removal of portions of the emitter tip and resistor layer or layers through the apertures in order to define the emitter tips and resistors. The mask may be disposed upon the field emission array by known processes, such as by the use of a photoresist material and by exposing and developing selected regions of the photoresist material to define the mask and the apertures therethrough. The emitter tips and resistors may be defined by known processes, such as by the use of etchants for the material or materials of the emitter tip and resistor layer or layers. Preferably, as regions of the emitter tip and resistor layer or layers are removed from the substantially longitudinal center portion of each of the conductive lines and as the emitter tips and resistors are defined, at least a lateral edge of the conductive lines remains covered with a material of the emitter tip and resistor layer or layers.

Adjacent columns of pixels of the field emission array may be electrically isolated from each other by removing at least the substantially longitudinal center portion of each of the conductive lines. An etchant that is selective for the conductive material of the conductive lines over the material or materials of the emitter tip and resistor layer or layers may be employed to remove conductive material from the substantially longitudinal center of each of the conductive lines and, thereby, to define the column lines and to electrically isolate adjacent column lines from one another.

The present invention also includes field emission arrays that have been fabricated in accordance with the method of the present invention. Thus, a field emission array according to the present invention may include a substrate with at least one resistor thereon, at least one lateral conductive layer, or column line, laterally adjacent the resistor, and at least one emitter tip disposed on the resistor. The substrate of the field emission array is exposed between adjacent column lines.

Other features and advantages of the present invention will become apparent to those of skill in the art through a consideration of the ensuing description, the accompanying drawings, and the appended claims.

DETAILED DESCRIPTION OF THE INVENTION

Figure 1:
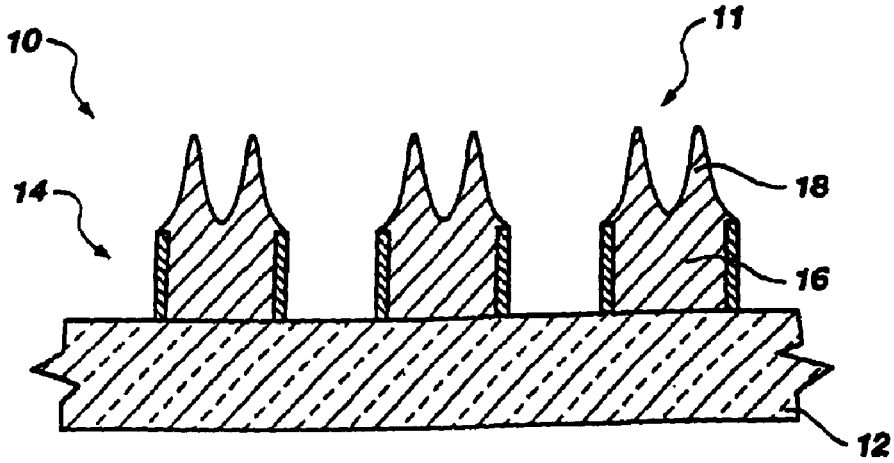
FIG. 1 is a cross-sectional schematic representation of a field emission array that may be fabricated in accordance with the method of the present invention.

With reference to FIG. 1, a field emission array 10 is illustrated. Field emission array 10 includes a substrate 12 upon which various features of field emission array 10, including the column lines 14, resistors 16, and emitter tips 18 thereof may be fabricated. A pixel 11 of field emission array 10 may include one or more emitter tips 18 and their associated, underlying resistor 16 or resistors. Each resistor 16 and its associated emitter tip 18 may be connected to, or otherwise in communication with, a relatively negative voltage source by means of one or more column lines 14, or lateral conductive layer, which are preferably disposed laterally adjacent a corresponding resistor 16.

Figure 2:
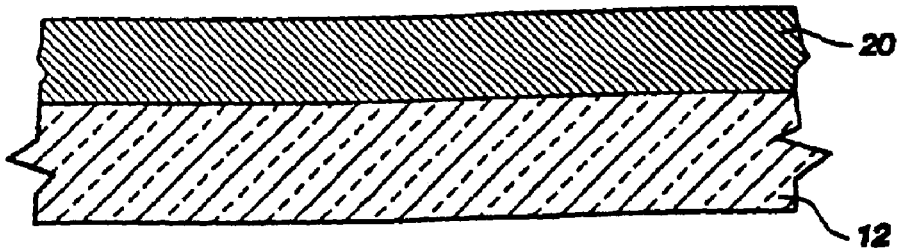
FIG. 2 is a schematic cross-sectional representation of the field emission array of FIG. 1, illustrating the blanket disposition of a layer of conductive material over a surface of a substrate.

With reference to FIG. 2, materials that may be employed as substrate 12 in the present invention include, without limitation, silicon, gallium arsenide, other semiconductive materials, silicon wafers, wafers of other semiconductive materials, silicon on glass ("SOG"), silicon on insulator ("SOI"), silicon on sapphire ("SOS"), and bare glass.

With continued reference to FIG. 2, a layer 20 of conductive material is disposed over substrate 12. Conductive materials, such as doped silicon, polysilicon, doped polysilicon, chromium, aluminum, molybdenum, copper, or other metals, may be employed as layer 20. The conductive material of layer 20 may be disposed over substrate 12 by known processes, such as by physical vapor deposition ("PVD") (e.g., sputtering) or by chemical vapor deposition ("CVD") (e.g., low pressure CVD ("LPCVD"), atmospheric pressure CVD ("APCVD"), or plasma-enhanced CVD ("PECVD")) processes. Layer 20 may be blanket deposited over substrate 12 or selectively deposited thereover.

Figure 3:
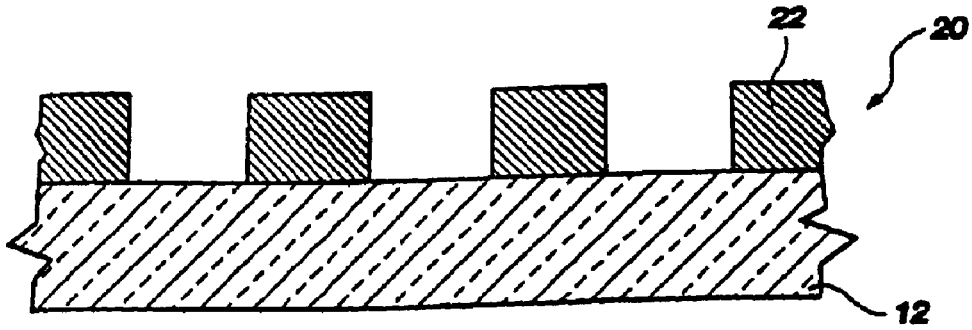
FIG. 3 is a schematic cross-sectional representation of the field emission array of FIG. 2, illustrating patterning of the layer of conductive material to define substantially mutually parallel conductive lines over the substrate.
Figure 3A:
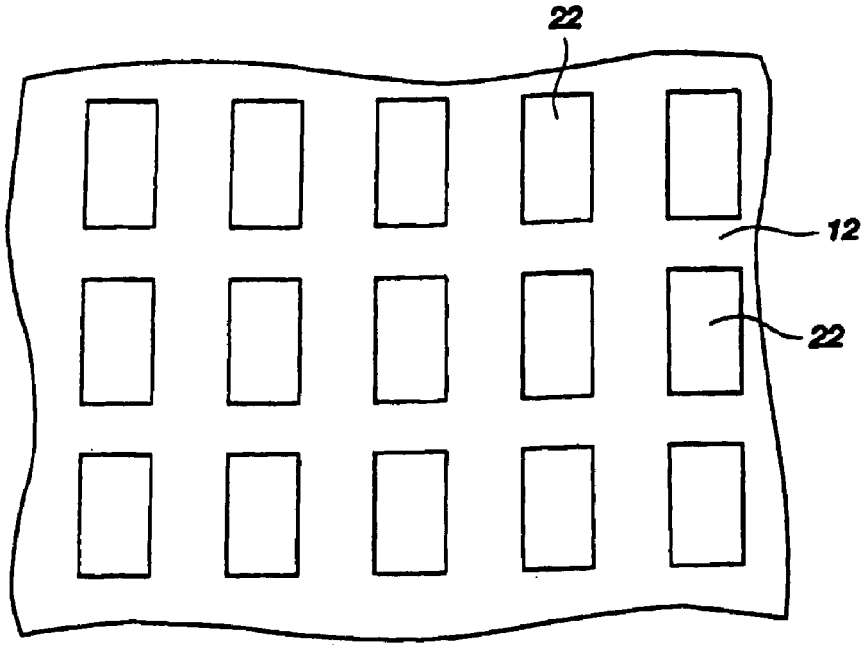
FIG. 3A is a schematic top view of the field emission array of FIG. 3.

With reference to FIGS. 3 and 3A, if layer 20 is blanket deposited over substrate 12, layer 20 may be patterned by known processes, such as by masking and etching techniques, to define substantially mutually parallel conductive lines 22 therefrom. If layer 20 is selectively deposited, the substantially mutually parallel conductive lines 22 may be fabricated during deposition of the conductive material of layer 20.

Figure 4:
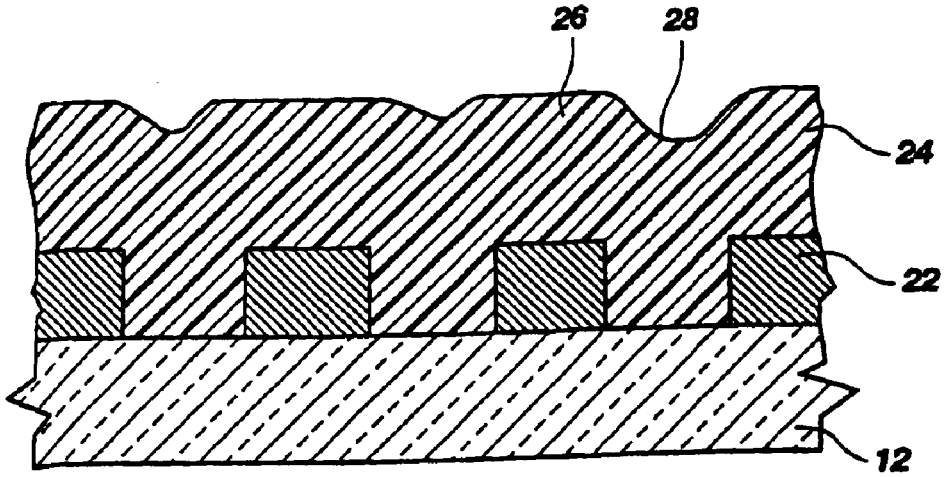
FIG. 4 is a schematic cross-sectional representation of the field emission array of FIG. 3, illustrating the disposition of an emitter tip-resistor layer over exposed portions of the substrate and over the substantially mutually parallel conductive lines.

Turning now to FIG. 4, a layer 24 of semiconductive material or conductive material, which is also referred to herein as a second layer or as an emitter tip-resistor layer, is disposed over conductive lines 22 and the regions of substrate 12 that are exposed between adjacent conductive lines 22. Since conductive lines 22 protrude somewhat from substrate 12 and layer 24 is disposed thereover in a substantially consistent thickness, layer 24 has a peak and valley appearance, with peaks 26 being located above conductive lines 22 and valleys 28, which are also referred to herein as depressions, being located between adjacent conductive lines 22.

Exemplary semiconductive materials that may be employed as layer 24 include, without limitation, single-crystalline silicon, amorphous silicon, polysilicon, and doped polysilicon. These materials may be deposited as known in the art, such as by chemical vapor deposition techniques. Of course, conductive materials having the desired properties and that are useful in fabricating emitter tips 18 and resistors 16 may also be employed in layer 24 and may be disposed over conductive lines 22 and the exposed regions of substrate 12 by known processes.

Figure 4A:
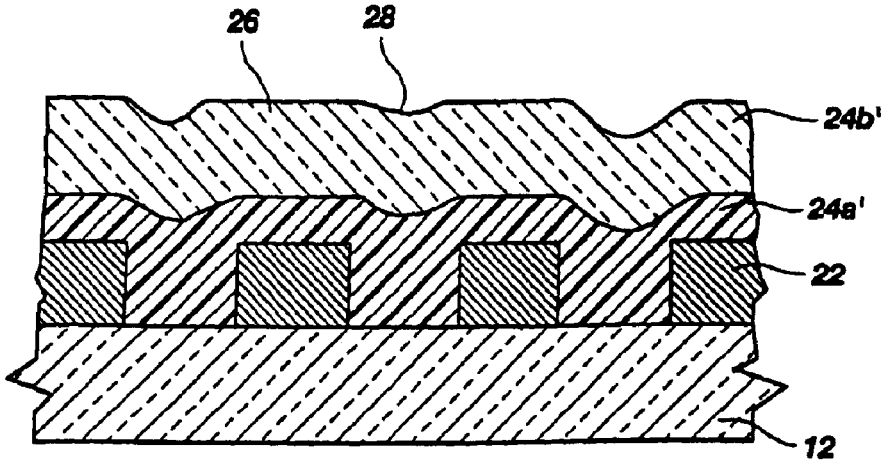
FIG. 4A is a schematic cross-sectional representation of a variation of the field emission array of FIG. 4, wherein the emitter tip-resistor layer comprises a layer of resistor material and a layer of emitter tip material disposed over the layer of resistor material.

Alternatively, it may be desirable to fabricate emitter tips 18 and resistors 16 from different semiconductive materials or conductive materials. For example, it may be desirable to fabricate resistors 16 from polysilicon, while a material such as single-crystalline silicon or amorphous silicon may be more desirable for fabricating emitter tips 18. Accordingly, with reference to FIG. 4A, a variation of the field emission array may include a resistor layer 24*a*' and an emitter tip layer 24*b*'. Resistor layer 24*a*' is disposed over conductive lines 22 and the regions of substrate 12 exposed between adjacent conductive lines 22. Emitter tip layer 24*b*' is disposed over resistor layer 24*a*'. As with layer 24 of FIG. 4, resistor layer 24*a*' and emitter tip layer 24*b*' may each have a peak and valley configuration.

Figure 5:
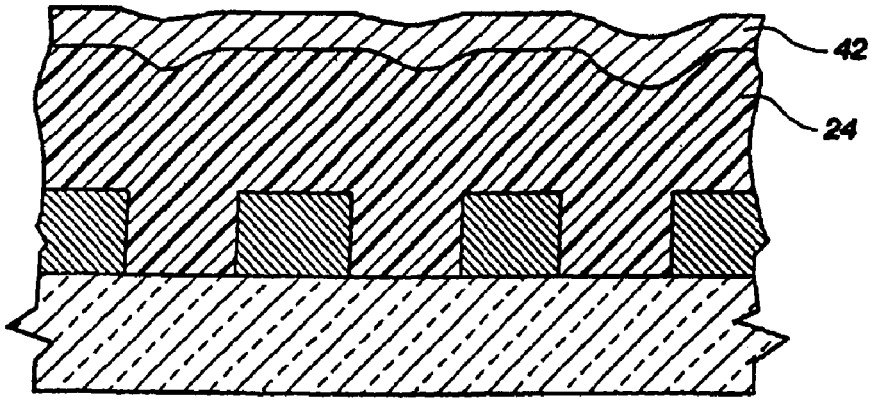
FIG. 5 is a schematic cross-sectional representation of the field emission array of FIG. 4, illustrating the disposition of a mask layer over the emitter tip-resistor layer.

Turning now to FIG. 5, a mask layer 42 of mask material may be disposed over emitter tip-resistor layer 24. Preferably, the material or materials of emitter tip-resistor layer 24 are selectively etchable with respect to the mask material. Accordingly, materials such as metals, metal oxides, silicon oxides, doped silicon oxides (e.g., borophosphosilicate glass ("BPSG"), phosphosilicate glass ("PSG"), borosilicate glass ("BSG"), etc.), or silicon nitrides may be employed as the mask material. Mask layer 42 may be disposed upon emitter tip-resistor layer 24 by known processes, such as by physical vapor deposition ("PVD"), chemical vapor deposition, growing the mask material onto the surface of emitter tip-resistor layer 24, or spinning the mask material thereon, depending upon the type of mask material employed.

Figure 6:
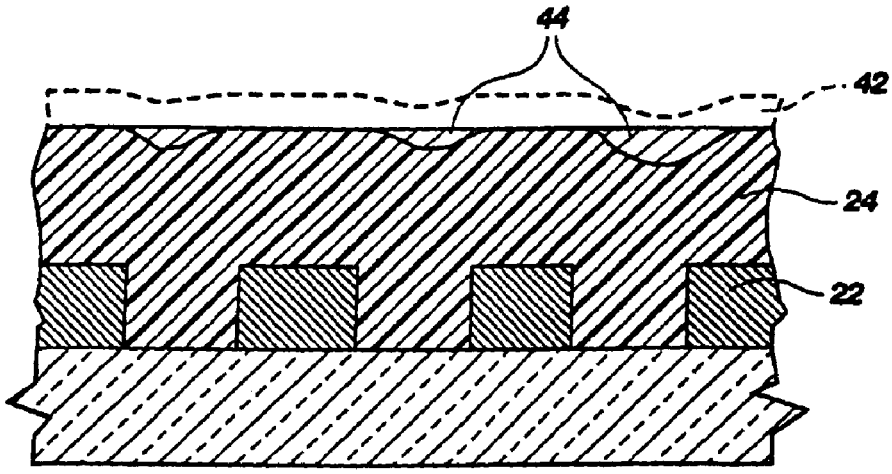
FIG. 6 is a schematic cross-sectional representation of the field emission array of FIG. 5, illustrating the removal of regions of the mask layer disposed substantially above the conductive lines to define a hard mask from the mask layer.

Referring now to FIG. 6, a so-called "hard mask" 44 may be formed on emitter tip-resistor layer 24 by removing the regions of mask layer 42 that are disposed substantially between conductive lines 22. These regions of mask layer 42 may be removed by known processes, such as by known planarization techniques, such as by the chemical-mechanical planarization ("CMP") or chemical-mechanical polishing techniques taught in U.S. Pat. Nos. 4,193,226 and 4,811,522, the disclosures of both of which are hereby incorporated in their entireties by reference. As hard mask 44 is formed, the portions of emitter tip-resistor layer 24 that are disposed substantially above at least the substantially longitudinal center portion of conductive lines 22 are exposed through hard mask 44.

Figure 7:
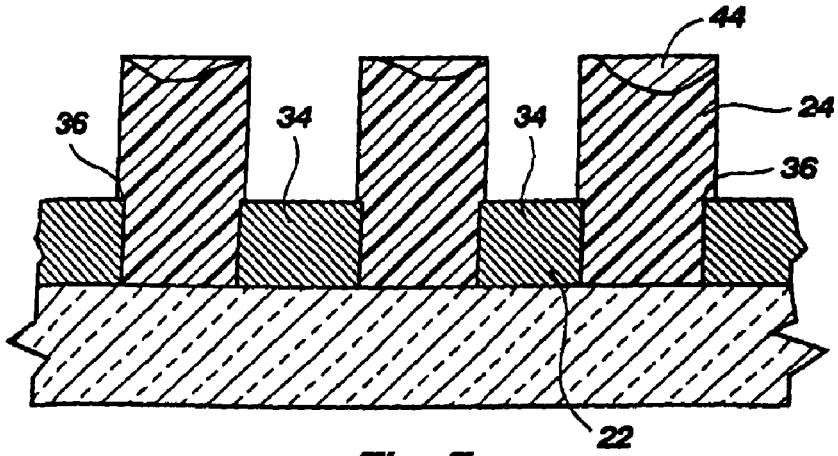
FIG. 7 is a schematic cross-sectional representation of the field emission array of FIG. 6, from which portions of the emitter tip-resistor layer disposed over the conductive lines have been removed through the hard mask.

FIG. 7 illustrates the removal of portions of emitter tip-resistor layer 24 that are exposed through hard mask 44 and the exposure of at least substantially longitudinal center portions 34 of conductive lines 22 through emitter tip-resistor layer 24. Preferably, the removal of these substantially longitudinal center portions 34 of emitter tip-resistor layer 24 is substantially anisotropic. The material or materials of the exposed portions of emitter tip-resistor layer 24 may be removed by known processes, such as by the use of etchants that are selective for one or more materials of emitter tip-resistor layer 24 over the mask material of hard mask 44. Preferably, at least a peripheral lateral edge portion 36 of selected conductive lines 22 remains covered by emitter tip-resistor layer 24 so as to facilitate the subsequent removal of only a portion of the selected conductive lines 22.

The use of a hard mask facilitates isolation of adjacent pixels independent of the heights of emitter tips 18 and resistors 16 (see FIG. 1). Accordingly, when such a hard mask 44 is employed, the relative heights of emitter tips 18 and resistors 16 are not determined by the height of conductive lines 22, as would be the case if conductive lines 22 were exposed during the definition of emitter tips 18 and resistors 16 (i.e., resistors 16 need not have substantially the same height as conductive lines 22).

Figure 8:
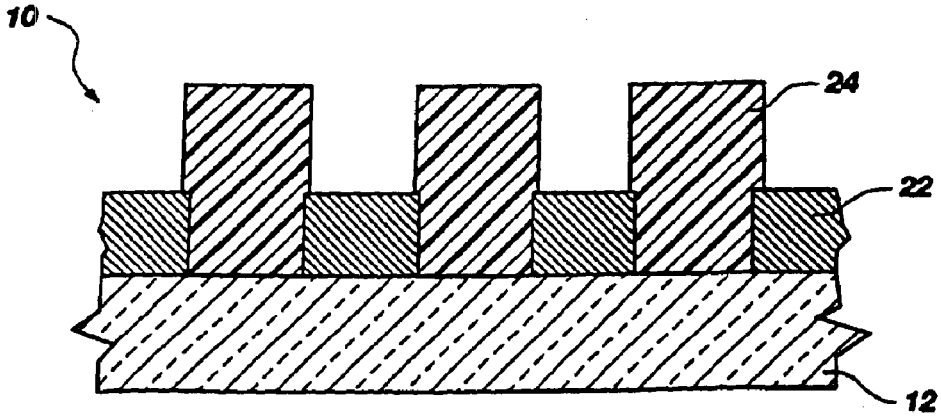
FIG. 8 is a schematic cross-sectional representation of the field emission array of FIG. 7, with the hard mask removed therefrom and illustrating planarization of the emitter tip-resistor layer.

Hard mask 44 may be removed from emitter tip-resistor layer 24 by known techniques, such as planarization processes (e.g., CMP) or the use of etchants that etch the material of hard mask 44 with selectivity over the material or materials of emitter tip-resistor layer 24. FIG. 8 illustrates field emission array 10 with the hard mask removed therefrom.

As shown in FIG. 8, the peaks 26 (see FIGS. 4 and 4A) and possibly portions of valleys 28 (see FIGS. 4 and 4A) have been substantially removed from the exposed surface of layer 24 during the definition and/or removal of hard mask 44 (see FIGS. 6 and 7) therefrom. Layer 24 may be planarized by known processes, such as CMP.

Figure 8A:
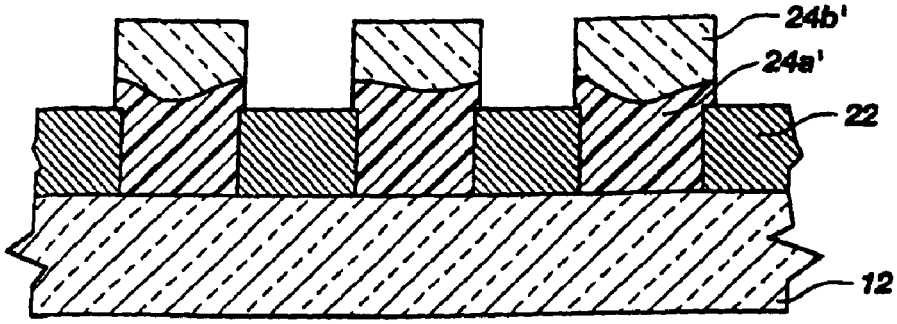
FIG. 8A is a schematic cross-sectional representation of the field emission array of FIG. 4A, from which portions of the emitter tip-resistor layer disposed above the conductive lines have been removed, and the remaining surface of the emitter tip layer has been planarized.

With reference to FIG. 8A, if emitter tip layer 24*b*' (see FIG. 4A) is planarized, such as by known chemical-mechanical planarization techniques, the portions of emitter tip layer 24*b*' that remain between adjacent conductive lines 22 preferably have a thickness that is sufficient to fabricate emitter tips 18 (see FIG. 1) of a desired height therefrom.

Figure 9:
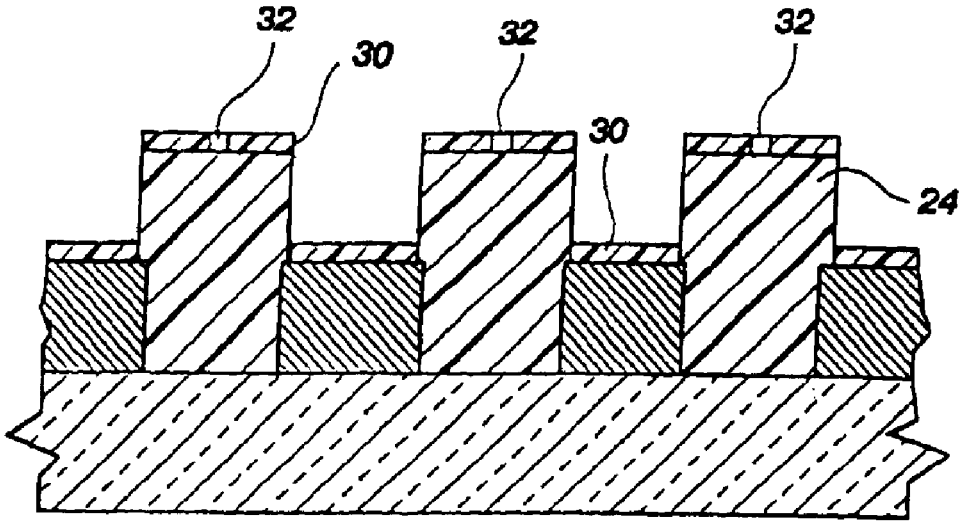
FIG. 9 is a schematic cross-sectional representation of the field emission array of FIG. 8, illustrating the disposition of a mask over the emitter tip-resistor layer.

Referring now to FIG. 9, the remainder of layer 24 may be patterned by disposing a mask 30 thereover and selectively removing portions of layer 24 through mask 30. Known techniques may be employed to dispose mask 30 over layer 24, and possibly over the exposed regions of conductive lines 22, such as disposing a layer of photoresist material over layer 24, and exposing and developing selected regions of the photoresist material to define apertures 32 therethrough in desired locations.

Figure 10:
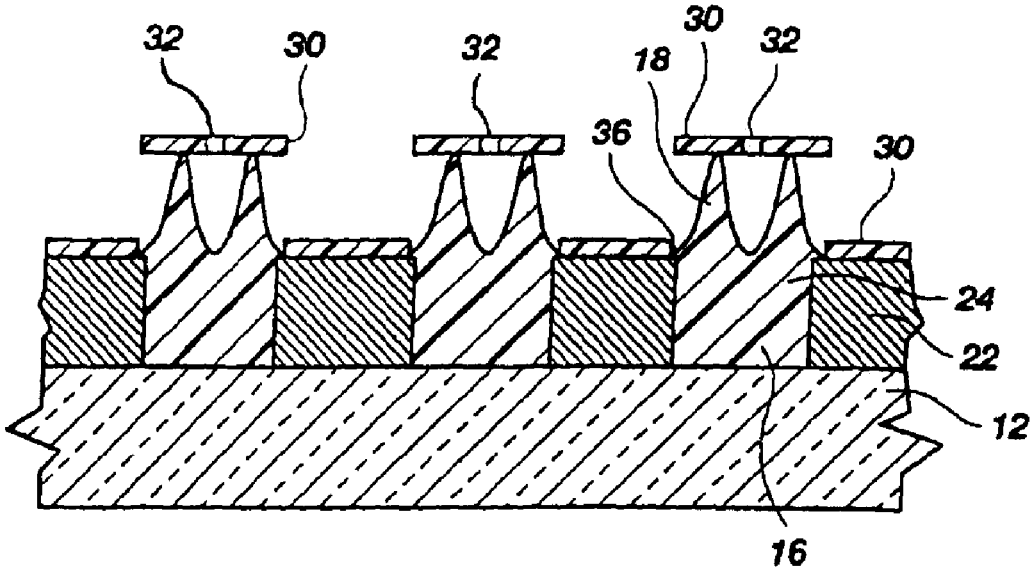
FIG. 10 is a schematic cross-sectional representation of the field emission array of FIG. 9, illustrating patterning of the emitter tip-resistor layer through apertures of the mask.

Turning now to FIG. 10, selected portions of the remainder of layer 24 may be removed through apertures 32 of mask 30 by known techniques, such as etching, to define emitter tips 18 and resistors 16. Either wet etching processes or dry etching processes may be employed. As emitter tips 18 may be conically shaped, the use of isotropic etching techniques is preferred. For example, if either single-crystalline or amorphous silicon is employed to fabricate emitter tips 18 (i.e., if these materials are employed as layer 24), wet etchants, such as mixtures of nitric acid ($HNO_3$) and hydrofluoric acid (HF), may be employed in known wet etch processes to remove material from selected regions of layer 24. As the exposure of conductive lines 22 through layer 24 and the definition of emitter tips 18 and resistors 16 from layer 24 may be effected through a single mask, each of these processes is said to occur substantially simultaneously for purposes of this disclosure. Preferably, as layer 24 is patterned, the material of layer 24 is not removed from (i.e., is maintained over) at least one peripheral edge portion 36 of each of conductive lines 22.

If mask 30 or portions thereof remain following the definition of emitter tips 18 and resistors 16, mask 30 may be removed from the surface of field emission array 10 by known processes. Any etchants may also be removed from field emission array 10 by known processes, such as by washing field emission array 10.

Figure 11:
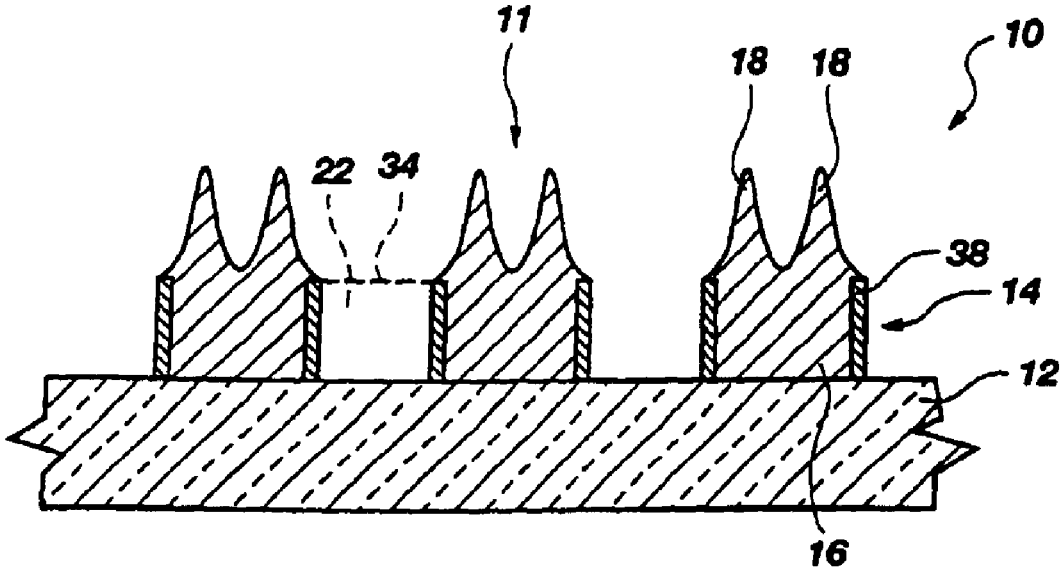
FIG. 11 is a schematic cross-sectional representation of the field emission array of FIG. 10, illustrating the definition of column lines and the electrical isolation of adjacent columns of pixels by removing a substantially longitudinal center portion of each of the conductive lines.

FIG. 11 depicts field emission array 10 following the removal of the conductive material of at least the substantially longitudinal center portion 34 of each conductive line 22. The conductive material of substantially longitudinal center portion 34 is substantially removed such that the underlying regions of substrate 12 are exposed and a lateral conductive layer 38 remains laterally adjacent each resistor 16.

Each column line 14 preferably comprises a lateral edge portion 36 that remains from at least one of the conductive lines 22 that was previously adjacent the resistor 16. The remaining lateral edge portion 36 of a patterned conductive line 22, which is preferably disposed laterally adjacent its associated resistor 16, is also referred to herein as a lateral conductive layer 38. Preferably, each column line 14 includes two lateral conductive layers 38 with at least one resistor 16 disposed therebetween.

Thus, as conductive lines 22 are patterned, column lines 14 are formed and adjacent columns of pixels 11 or emitter tips 18 are substantially electrically isolated from each other. If an etchant or etchants are employed to pattern conductive lines 22, any remaining etchants may be removed from field emission array 10 after the desired patterning has been performed. Etchants may be removed by known processes, such as by washing field emission array 10.

The conductive material of substantially longitudinal center portion 34 of conductive lines 22 may be removed therefrom by known processes, such as by known etching techniques. While either dry etching or wet etching techniques may be employed to pattern conductive lines 22, substantially anisotropic etching of conductive lines 22 is preferred so as to facilitate the formation of lateral conductive layers 38 of substantially uniform thickness. For example, if conductive lines 22 comprise polysilicon, a dry etchant, such as a chlorine etchant, a fluorine etchant, or a combination thereof (e.g., $SF_6$ and $Cl_2$), may be employed in a dry etch process, such as glow-discharge sputtering, ion milling, reactive ion etching ("RIE"), reactive ion beam etching ("RIBE"), or high-density plasma etching.

Conductive lines 22 may be patterned at any point when substantially longitudinal center portions 34 are exposed. For example, conductive lines 22 may be patterned prior to disposing layer 24 onto substrate 12, after conductive lines 22 are exposed through layer 24, or after emitter tips 18 and resistors 16 are defined.

The method of the present invention requires fewer fabrication steps than conventional field emission array fabrication processes. Accordingly, the method of the present invention may also facilitate a reduction in failure rates and production costs of field emission arrays.

Although the foregoing description contains many specifics and examples, these should not be construed as limiting the scope of the present invention, but merely as providing illustrations of some of the presently preferred embodiments. Similarly, other embodiments of the invention may be devised which do not depart from the spirit or scope of the present invention. The scope of this invention is, therefore, indicated and limited only by the appended claims and their legal equivalents, rather than by the foregoing description. All additions, deletions and modifications to the invention as disclosed herein and which fall within the meaning of the claims are to be embraced within their scope.

What is claimed is:

1. A method for fabricating at least one emission structure, comprising:

forming at least one conductive structure extending across at least a portion of a substrate;

substantially removing a longitudinal portion of the at least one conductive structure to define at least one conductive layer having a width that is oriented substantially perpendicular to the substrate, the substrate being exposed along a length of the at least one conductive layer; and forming at least one emission structure adjacent the at least one conductive layer.

2. The method of claim 1, wherein forming the at least one emission structure includes forming an emitter tip.

3. The method of claim 2, wherein forming the at least one emission structure further includes forming a resistor corresponding to the emitter tip.

4. The method of claim 3, wherein forming the resistor comprises forming the resistor adjacent to the at least one conductive layer.

5. The method of claim 1, wherein forming the at least one emission structure comprises forming a plurality of lines of emission structures.

6. The method of claim 5, wherein substantially removing comprises electrically isolating at least one emission structure located along a first line of the plurality of lines from at least one emission structure located along an adjacent, second line of the plurality of lines.

7. The method of claim 1, wherein forming the at least one conductive structure comprises:

disposing a layer comprising conductive material over the substrate; and patterning the layer.

8. The method of claim 1, wherein forming the at least one emission structure comprises forming the at least one emission structure from at least one of semiconductive material and conductive material.

9. The method of claim 1, wherein forming the at least one emission structure comprises forming the at least one emission structure so as to extend over a lateral edge of the at least one conductive structure.

10. A method for fabricating at least one emission structure, comprising:

forming at least one conductive structure that extends at least partially across a substrate;

forming at least one emitter tip and a corresponding resistor adjacent to the at least one conductive structure; and substantially removing at least a longitudinal portion of the at least one conductive structure along substantially an entire length thereof to define at least one conductive layer having a width that is oriented substantially perpendicular to the substrate.

11. The method of claim 10, wherein forming the at least one conductive structure comprises:

disposing a layer comprising conductive material on the substrate; and patterning the layer.

12. The method of claim 10, wherein forming the at least one emitter tip comprises forming the at least one emitter tip from at least one of semiconductive material and conductive material.

13. The method of claim 10, wherein forming the corresponding resistor comprises forming the corresponding resistor from at least one of semiconductive material and conductive material.

14. The method of claim 10, wherein forming the at least one emitter tip comprises:

disposing at least one layer comprising at least one of semiconductive material and conductive material over the substrate and the at least one conductive structure;

removing a longitudinal portion of at least one region of the at least one layer located over the at least one conductive structure to expose at least a substantially longitudinal portion of the at least one conductive structure; and patterning at least one remaining portion of the at least one layer.

15. The method of claim 14, wherein patterning the at least one remaining portion of the at least one layer includes defining the at least one emitter tip from the at least one layer.

16. The method of claim 15, wherein patterning the at least one remaining portion of the at least one layer further includes forming the corresponding resistor.

17. The method of claim 10, wherein substantially removing comprises leaving at least a lateral edge of the at least one conductive structure along substantially the entire length thereof.

18. The method of claim 10, wherein forming the at least one emitter tip comprises forming the at least one emitter tip so as to extend over a lateral edge of the at least one conductive structure.

* * * * *

UNITED STATES PATENT AND TRADEMARK OFFICE

CERTIFICATE OF CORRECTION

PATENT NO. : 6,957,994 B2
APPLICATION NO. : 10/654226
DATED : October 25, 2005
INVENTOR(S) : Ammar Derraa It is certified that error appears in the above-identified patent and that said Letters Patent is hereby corrected as shown below:

In the specification

COLUMN 2, LINES 17, 18, 29, 32, and 39,
change "'868 Patent" to --'868 Patent--

Signed and Sealed this

Twentieth Day of November, 2007

JON W. DUDAS
*Director of the United States Patent and Trademark Office*